US006917269B2

(12) United States Patent
Bach et al.

(10) Patent No.: US 6,917,269 B2
(45) Date of Patent: Jul. 12, 2005

(54) LOW-VOLTAGE CIRCUIT BREAKER WITH AN ELECTRIC ARC EXTINCTION SYSTEM

(75) Inventors: Michael Bach, Berlin (DE); Detlev Schmidt, Berlin (DE); Michael Sebekow, Berlin (DE); Günter Seidler, Berlin (DE); Ingo Thiede, Berlin (DE); Sezai Türkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/469,875

(22) PCT Filed: Feb. 20, 2002

(86) PCT No.: PCT/DE02/00654

§ 371 (c)(1),
(2), (4) Date: Sep. 5, 2003

(87) PCT Pub. No.: WO02/071428

PCT Pub. Date: Sep. 12, 2002

(65) Prior Publication Data

US 2004/0188388 A1 Sep. 30, 2004

(30) Foreign Application Priority Data

Mar. 6, 2001 (DE) ..... 201 04 325 U

(51) Int. Cl.[7] ..... H01H 9/30; H01H 33/04

(52) U.S. Cl. ..... 335/201; 218/1; 218/15; 218/149; 218/156

(58) Field of Search ..... 218/1, 15, 46, 218/47, 76, 90, 149–158; 335/201

(56) References Cited

U.S. PATENT DOCUMENTS 3,296,402 A 1/1967 Meinders et al. ..... 218/37
4,935,589 A * 6/1990 Kohanawa ..... 218/152

FOREIGN PATENT DOCUMENTS

| | | |
|---|---|---|
| DE | 1746087 | 6/1957 |
| DE | 19715116 | 10/1998 |
| WO | WO9847161 | 10/1998 |

* cited by examiner

*Primary Examiner*—Ramon M. Barrera
(74) *Attorney, Agent, or Firm*—Harness, Dickey & Pierce, P.L.C.

(57) ABSTRACT

An electric arc extinction chamber system, especially for low-voltage circuit breakers of very high nominal current intensities, wherein parallel electric arc extinction chamber inserts are provided in a housing extending over the entire width of a pole-face arc. The housing of the chamber is sub-divided by a partition wall or several partition walls which are embodied as components of the housing. The compartments thus formed receive arc splitter cartridges.

15 Claims, 1 Drawing Sheet

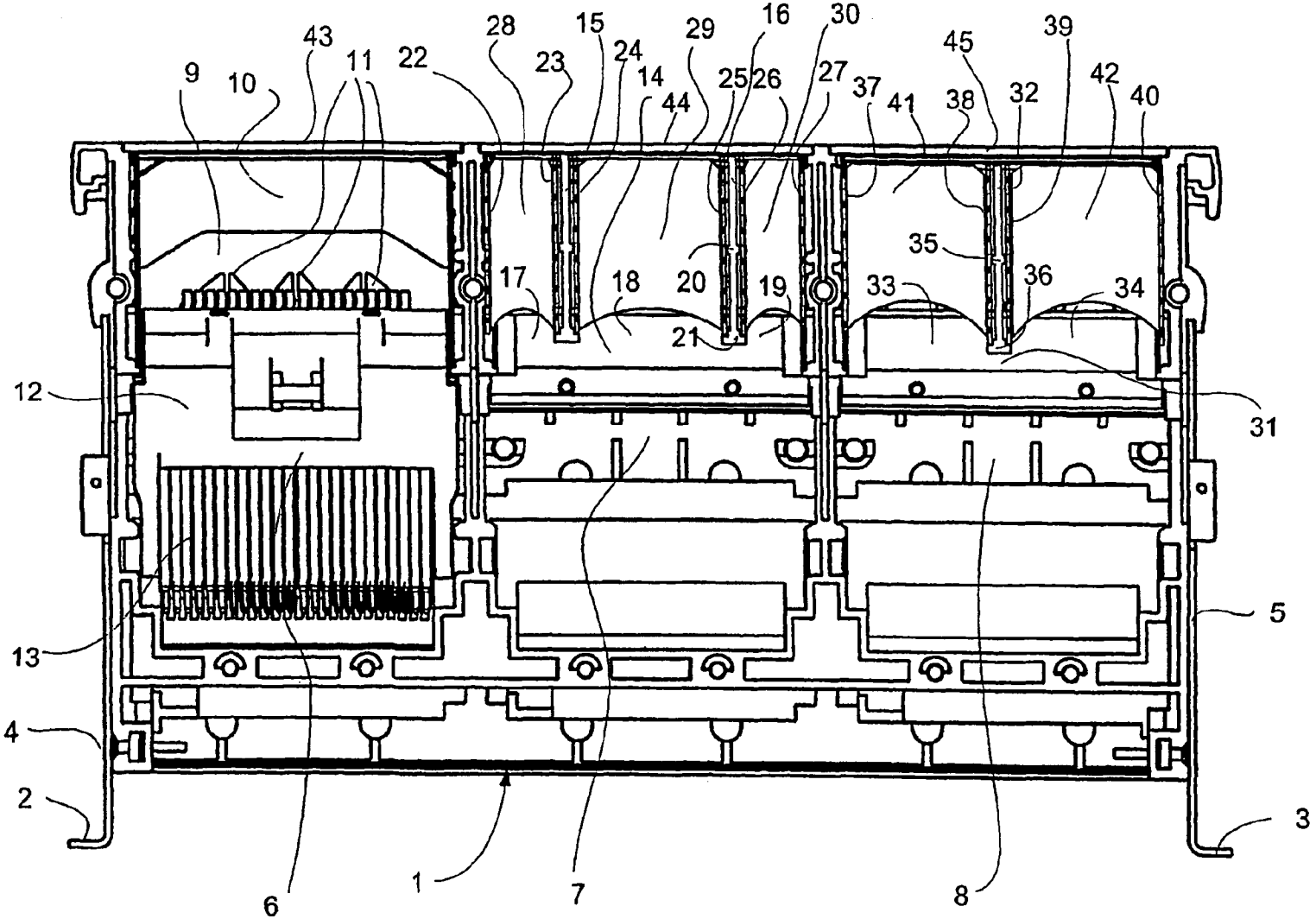
3
5
31
40
42
34
39
36
32
45
38
35
41
33
37
30
27
16
26
19
25
29
20
21
44
14
24
18
15
23
17
28
22
11
43
10
9
8
7
1
6
12
13
4
2

LOW-VOLTAGE CIRCUIT BREAKER WITH AN ELECTRIC ARC EXTINCTION SYSTEM

This application is the national phase under 35 U.S.C. § 371 of PCT International Application No. PCT/DE02/00654 which has an International filing date of Feb. 20, 2002, which designated the United States of America and which claims priority on German Patent Application number DE 201 04 325.4 filed Mar. 6, 2001, the entire contents of which are hereby incorporated herein by reference.

FIELD OF THE INVENTION

The present invention generally relates to a low-voltage power breaker having an arc-quenching system, in particular for low-voltage power breakers having very high rated current values, in which parallel arc-quenching chamber inserts are provided in a chamber enclosure which extends over the entire width of the poles.

BACKGROUND OF THE INVENTION

Air-break low-voltage switching devices, such as low-voltage power breakers, require for their operation an arc-quenching device, in the form of arcing chambers for cooling and quenching arcs which occur when the contact is broken. Such an arc-quenching device is capable of quenching any arcs that occur without adversely affecting the power breaker itself and adjacent parts of the system or other assemblies, since, otherwise, there would be a risk of the hot and thus ionized arc gases causing electrical flashovers or resulting in other damage. Each arc-quenching chamber generally includes a large number of arc splitter plates, which are arranged between two side walls and contribute to the cooling and quenching of the arc. Two fundamentally different physical forms of conventional arc-quenching devices are known for low-voltage power breakers. Until now, for large power breakers, complete arcing chambers produced essentially in a conventional manner, separately as a component, i.e. a robust arc-, pressure- and temperature-resistant enclosure containing arc splitter plates and having a suitable blowing apparatus, have been fitted to the power breaker. One arcing chamber is generally provided per pole. This chamber has a complete enclosure whose strength is matched to both the mechanical and the electrical forces of the arc which occurs in it and is to be quenched, in particular with regard to the pressure and the temperature of the switching gases. The arc splitter plates are located in this chamber. The chamber may in this case be in the form of a pot-like shaft into which the plates are inserted, or may be in the form of a structure composed of half-shells, for which an apparatus is required, firstly for inserting the plates into one half-shell, then for fitting the second half-shell, and finally for connecting the two half-shells.

A second physical form makes use of arcing chamber inserts, with which only the function of actual arc quenching can be achieved in one unit. These structures are, however, not capable of withstanding the pressure occurring in connection with the arc. These inserts are therefore inserted in a shaft which is provided in or on the breaker enclosure. Until now, this physical form has predominantly been used for small, compact power breakers, but is increasingly also being used for larger power breakers where the enclosures surround these areas, i.e. the switching area and the quenching area.

With regard to the connection to the main body of the power breaker and the connection of its individual parts to one another, both types have the object of sealing the technically required gaps and joints to prevent the ionized arc gases passing through them, and of preventing electrical flashovers caused by gases which may nevertheless occur.

The arc-quenching chambers can have entirely different dimensions which are dependent on the dimensions of the entire contact system, since the arc-quenching chamber should after all accommodate the arc which runs from the contact system. In this case, low-voltage power breakers having a high rated current have, as a function of the rated or continuous current of the breaker and as a function of the operation, a very wide contact system.

The arc-quenching chamber does not necessarily have to cover the entire width, rather it is sufficient to join the arc by way of a horn and then to pass it into a relatively narrow chamber which is dimensioned such that it has the switching capacity produced by the short-circuit switching capacity of the breaker.

If, however, the contact system is wider than the arc-quenching chamber, this results in a system in which guides are provided to enable the arc to be formed from all of the arc elements which may be struck, and in which the guides guide the arc onto arcing horns which are provided and open into the chamber. Accordingly, these additional guides are necessary, which leads to additional complexity in terms of materials and assembly and to additional expense in connection with this.

It has been proven, however, that it is advantageous and expedient if the chamber is as wide as the contact system and that the arc, irrespective of whether it runs on the left, the right or in the center, runs into the arcing chamber where it can become broader. Extremely wide arc-quenching chambers are, however, deemed unfavorable to a certain extent with regard to the quenching behavior in the case of short-circuit current disconnections. The area available is therefore advantageously filled in a modular fashion using smaller inserts.

Such an arrangement is proposed in DE 197 15 116 C2 (WO 98/47161). In this case, an arcing chamber system having a chamber body is described in which a large number of grooves are arranged on the insides of two opposite side walls, and a number of arcing chamber modules, which each have two opposite side parts, between which a large number of arc splitter plates are in each case arranged, the side parts of the arcing chamber modules being inserted into the corresponding grooves in the side walls.

The grooves provided in the walls of the chamber body reduce the strength of the chamber body, and the base body must have, overall, a greater material strength. This means increased use of materials and an increased weight. A further arc-quenching arrangement is disclosed in DE 17 46 087 U1. A number of isolating profiled bodies are arranged in a retaining frame, which is formed by two flat elements and two U-shaped elements, U-shaped profiled bodies and, in between, double T-shaped profiled bodies in each case being arranged in the edge regions, such that cavities are formed between two adjacent profiled bodies. Grooves are provided on the insides of these cavities for accommodating arc splitter plates. This arrangement can be regarded as an arc-quenching chamber, but no arcing chamber modules are used and neither is there a chamber body since the profiled elements are only held together by a retaining frame.

SUMMARY OF THE INVENTION

An object of the present invention is to provide a low-voltage power breaker having an arc-quenching device that may be matched in a simple manner to a predetermined switching capacity and which does not have strength-reducing elements, such as grooves in the enclosure walls.

An object of the present invention is achieved, in the case of a low-voltage power breaker, by the fact that, in order to retain the arc-quenching chamber inserts, one or more partitions are provided, which divide the entire arc-quenching area of the chamber enclosure into compartments. Here, these partitions are advantageously formed as part of the enclosure.

The partitions are expediently arranged parallel to one another and equidistant from one another. Compartments of equal size are then formed in the entire arc-quenching area. The partitions can, however, also be arranged at different distances from one another such that compartments of differing size are formed.

These different arrangements can be provided, as a function of a different distribution of the contact levers, with or without a primary arcing contact and arcing horn, on the contact support, since the distribution of base points for the arc elements forming should also expediently be configured as a function of the distribution of these contact levers.

An appropriate arc splitter cartridge is inserted in each of these compartments which are formed by said partitions. These arc splitter cartridges include a number of arc splitter plates, which are arranged between two isolating walls arranged parallel to one another, and form autonomous components which can be inserted or withdrawn individually.

In order to support and accommodate the arc splitter cartridges, the partitions have support elements and holders for the isolating walls of the arc splitter cartridges. In order to retain the arc splitter cartridges in the entire arc-quenching area, one arcing chamber cover is provided with a switching pole. These arcing chamber covers and arc splitter cartridges are independent of one another and can be inserted and removed individually.

Arc guide horns are provided on the fixed terminal bar of the low-voltage power breaker to match the distribution of the contact levers with or without a primary arcing contact and arcing horns and the distribution of the base points for the arc elements by the arrangement of the arc splitter cartridges. In this case, one arc guide horn is advantageously arranged on the fixed terminal bar for each quenching device element.

Further scope of applicability of the present invention will become apparent from the detailed description given hereinafter. However, it should be understood that the detailed description and specific examples, while indicating exemplary embodiments of the present invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

The single FIGURE illustrates a cross-sectional illustration of a three-pole low-voltage power breaker.

DETAILED DESCRIPTION OF EXEMPLARY EMBODIMENTS

The low-voltage power breaker 1 illustrated in the figure shows the breaker feet 2, 3, the side walls 4, 5 and the three switching poles 6, 7, 8. Here, in the present example, the switching poles 6, 7, 8 are illustrated as possible different exemplary embodiments.

The left-hand switching pole 6 in the figure shows a conventional arc splitter arrangement 10, which extends over the entire width of the entire arc-quenching area 9, having arc guide horns 11 located underneath which are distributed uniformly over the width of the switching pole 6, as well as the moveable contact levers 12 on the moveable contact support 13. The upper closure of the entire arc-quenching area 9 is formed by a arcing chamber cover 43 which at the same time performs the function of retaining the arc splitter arrangement 10. A design of this kind for the quenching system is customary for conventional contact lever arrangements in which contact levers without a primary arcing contact are arranged on the outside and contact levers with a primary arcing contact are arranged in the center.

For the central switching pole 7, the entire arc-quenching area 14 is divided by two partitions 15, 16 such that two narrower compartments 17, 19 are formed on the lateral edge regions of the entire arc-quenching area 14, and, in the central region, a wider compartment 18. The partitions 15, 16 are part of the enclosure and have support elements 20 and holders 21 for the isolating walls 22, 23, 24, 25, 26, 27 of the arc splitter cartridges 28, 29, 30. The upper closure of the entire arc-quenching area 14 is formed by a arcing chamber cover 44 which at the same time performs the function of retaining the arc splitter cartridges 28, 29, 30.

For the right-hand switching pole 8, the entire arc-quenching area 31 is divided by a partition 32 into two compartments 33, 34 which are both of equal size. The partition 32 is part of the enclosure in this case too and has support elements 35 and holders 36 for the isolating walls 37, 38, 39, 40 of the arc splitter cartridges 41, 42. The upper closure of the entire arc-quenching area 31 is formed by a arcing chamber cover 45 which at the same time performs the function of retaining the arc splitter cartridges 41, 42.

The major advantage of the solution according to the invention is the fact that the arc splitter cartridges are held in the arcing chamber. The mechanical difference is that, instead of the grooves in the chamber enclosure into which the arc splitter stacks are pushed, partitions are provided for holding the arc splitter stacks in the arcing chamber.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE NUMERALS

1 Low-voltage power breaker
2 Breaker foot
3 Breaker foot
4 Side wall
5 Side wall
6 Switching pole
7 Switching pole
8 Switching pole
9 Entire arc-quenching area
10 Arc splitter arrangement
11 Arc guide horn
12 Contact lever
13 Contact support
14 Entire arc-quenching area

15 Partition
16 Partition
17 Compartment
18 Compartment
19 Compartment
20 Support element
21 Holder
22 Isolating wall
23 Isolating wall
24 Isolating wall
25 Isolating wall
26 Isolating wall
27 Isolating wall
28 Arc splitter cartridge
29 Arc splitter cartridge
30 Arc splitter cartridge
31 Entire arc-quenching area
32 Partition
33 Compartment
34 Compartment
35 Support element
36 Holder
37 Isolating wall
38 Isolating wall
39 Isolating wall
40 Isolating wall
41 Arc splitter cartridge
42 Arc splitter cartridge
43 Arcing chamber cover
44 Arcing chamber cover
45 Arcing chamber cover

What is claimed is:

1. A low-voltage power breaker, comprising:

at least one pole;

parallel arc-quenching chamber inserts arranged in a chamber enclosure of the pole which extends over an entire width of the pole and encloses an entire arc-quenching area of the pole, the arc-quenching chamber inserts each having two opposite side elements for holding arc splitter plates; and at least one partition for retaining the arc-quenching chamber inserts, the at least one partition for dividing the entire arc-quenching area of the chamber enclosure of the pole into at least two compartments.

2. The low-voltage power breaker as claimed in claim 1, wherein the at least one partition is formed as part of the enclosure.

3. The low-voltage power breaker as claimed in claim 1, wherein at least two partitions are provided and the partitions are arranged as parallel to one another.

4. The low-voltage power breaker as claimed in claim 1, wherein a plurality of compartments arc formed by a plurality of partitions, and the compartments are of differing size.

5. The low-voltage power breaker as claimed in claim 2, wherein at least two partitions are provided and the partitions are arranged as parallel to one another.

6. The low-voltage power breaker as claimed in claim 2, wherein a plurality of compartments are formed by a plurality of partitions, and the compartments are of differing size.

7. The low-voltage power breaker as claimed in claim 3, wherein a plurality of compartments are formed by a plurality of partitions, and the compartments are of differing size.

8. The low-voltage power breaker as claimed in claim 1, wherein a plurality of partitions are provided.

9. The low-voltage power breaker as claimed in claim 8, wherein the plurality of partitions divide the entire arc-quenching area of the chamber enclosure into a plurality of compartments.

10. A voltage power breaker, comprising:

at least one pole;

arc-quenching chamber inserts arranged in a chamber enclosure of the pole enclosing an entire arc-quenching area of the pole, the arc-quenching chamber inserts each having side elements for holding arc splitter plates; and at least one partition for retaining the arc-quenching chamber inserts, the at least one partition for dividing the entire arc-quenching area of the chamber enclosure into at least two compartments.

11. The voltage power breaker according to claim 10, wherein a plurality of partitions are provided.

12. The voltage power breaker according to claim 11, wherein the plurality of partitions divide the entire arc-quenching area of the chamber enclosure into a plurality of compartments.

13. The voltage power breaker according to claim 10, wherein at least two partitions are provided and the partitions are arranged as parallel to one another.

14. The voltage power breaker according to claim 10, wherein a plurality of compartments are formed by a plurality of partitions, and the compartments are of differing size.

15. A voltage power breaker, comprising:

an enclosure defining an arc-quenching area of a pole;

at least two arc-quenching chamber inserts arranged in the arc-quenching area of the pole, the arc-quenching chamber inserts holding arc splitter plates; and a partition dividing the arc-quenching area of the pole into at least two compartments, the partition retaining the arc-quenching chamber inserts.

* * * * *